US006122891A

United States Patent [19]

Carpenter

[11] Patent Number: 6,122,891

[45] Date of Patent: Sep. 26, 2000

[54] ROOFING TOOL SYSTEM AND METHOD

[76] Inventor: James H. Carpenter, 18212 E. LaSalle Pl., Aurora, Colo. 80013

[21] Appl. No.: 09/239,917

[22] Filed: Jan. 28, 1999

[51] Int. Cl.[7] ..... E04D 15/02; B26D 7/01

[52] U.S. Cl. ..... 52/748.1; 52/746.11; 52/749.12; 83/467.1; 83/468.1; 83/607; 83/920

[58] Field of Search ..... 52/746.11, 748.1, 52/749.1, 749.12; 83/467.1, 468.1, 607, 920

[56] References Cited

U.S. PATENT DOCUMENTS 2,345,450 3/1944 Blanc ..... 83/607 X
3,089,373 5/1963 Fischer et al. ..... 83/607 X
4,010,592 3/1977 Nixon ..... 52/749.12 X

*Primary Examiner*—Christopher T. Kent
*Attorney, Agent, or Firm*—Ramon L. Pizarro; Edwin H. Crabtree

[57] ABSTRACT

A tool and a method for cutting and installing roofing shingles. The tool includes a base with a work surface and a cutter for cutting shingles placed on the work surface. The work surface include at least one limiting pedestals which includes an edge at a distance from the work surface, so that several shingles stacked over one another and placed over the work surface and slid against the edge of the limiting pedestal to expose different proportions of the shingles to the cutter to produce shingle sections of different sizes. The different sized shingle sections are then used to start the rows of shingles placed on the roof to be covered with shingles.

17 Claims, 6 Drawing Sheets

ROOFING TOOL SYSTEM AND METHOD

BACKGROUND OF THE INVENTION (a). Field of the Invention

This invention generally relates to a system and tools for cutting and placement of shingles on roofs. More particularly, but not by way of limitation to a cutting tool system that serves for cutting roofing shingles and for a method of installing a roof using the cutting tool system.

(b). Discussion of Known Art

The use of shingles, and particularly composite shingles, have become very popular due to the durability and relatively low cost as compared to materials such as clay tiles or wood shake roofing material. While we continue to witness significant advances in the development of improved materials for the fabrication of composite shingles, the installation of the shingles has experienced little advancement. The installation of the composite shingles continues to be a labor intensive process which places a great deal of emphasis on the use of manual labor, depending the skill and effectiveness of the person carrying out the installation.

A significant problem associated with the process of installing the composite shingle material over the roof to be covered is that to start the coverage of the roof with the shingles, one must first position at an appropriate location at one of the lower extremes of the roof, and then continue to attach shingles over the roof with shingles that are indexed relative to the shingles that have already been installed. Therefore, it is important to ensure that the entire process is commenced with properly positioned shingles.

Another significant problem with traditional installation methods is that the installer must position the first shingle of each row in a staggered manner, beginning at the rake edge, side edge, wall hip, or valley of the roof. Once the first shingle has been positioned at the proper location over the previous row, the shingle must then be cut to match the edge or rake edge of the roof or next to the intersection of the roof and a wall. This step of cutting the shingle to match the edge is typically carried out with the aid of a hand held utility knife. The use of this method leads to unreliable results, since the cutting depends on the strength and steadiness of the installer's hand. Moreover, the cut portions which had extended beyond the edge or rake edge of the roof must frequently be discarded since they of random dimensions.

Known devices for cutting shingles include the devices shown in U.S. Pat. No. 5,787,781 to Hile, in U.S. Pat. No. 5,249,495 to Renk and in U.S. Pat. No. 1,918,104 to Hook. Other cutting devices are shown in U.S. Pat. No. 792,636 to Pottern, in U.S. Pat. No. 3,134,285 to Greene, in U.S. Pat. No. 2,185,985 to Lund, in U.S. Pat. No. 1,092,381 to Neely, and in U.S. Pat. No. 639,231 to Hale.

SUMMARY

It has been discovered that the problems left unanswered by known art can be solved by providing a tool for cutting roofing shingles which includes:

1) a base having a work surface with an edge;
2) a cutter for cutting shingles along the edge of the base when shingles are placed on the work surface; and
3) limiting pedestals.

In a highly preferred embodiment of the invention two limiting pedestals are used over the work surface. Each of the limiting pedestals will include an edge that serves for locating the shingles over the work surface, so that when the edge of a shingle is positioned against the edge of the pedestal, a section of the shingle will extend over the edge of the work surface at a location where the shingle is to be cut.

According to another aspect of the disclosed invention, a method for installing a shingled roof over a roof having a rake edge, a slope and an eave or wall edge has been disclosed. The method includes the steps of:

1) providing shingles of a size and thickness;
2) providing a tool for cutting shingles, the tool being as summarized above, with each limiting pedestal being at a distance that is approximately equal to integer multiples of the thickness of the shingles to be used;
3) cutting the shingles over the work surface with the cutter to produce several cut shingles; and
4) attaching the cut shingles against the rake or wall edge of the roof to be covered.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
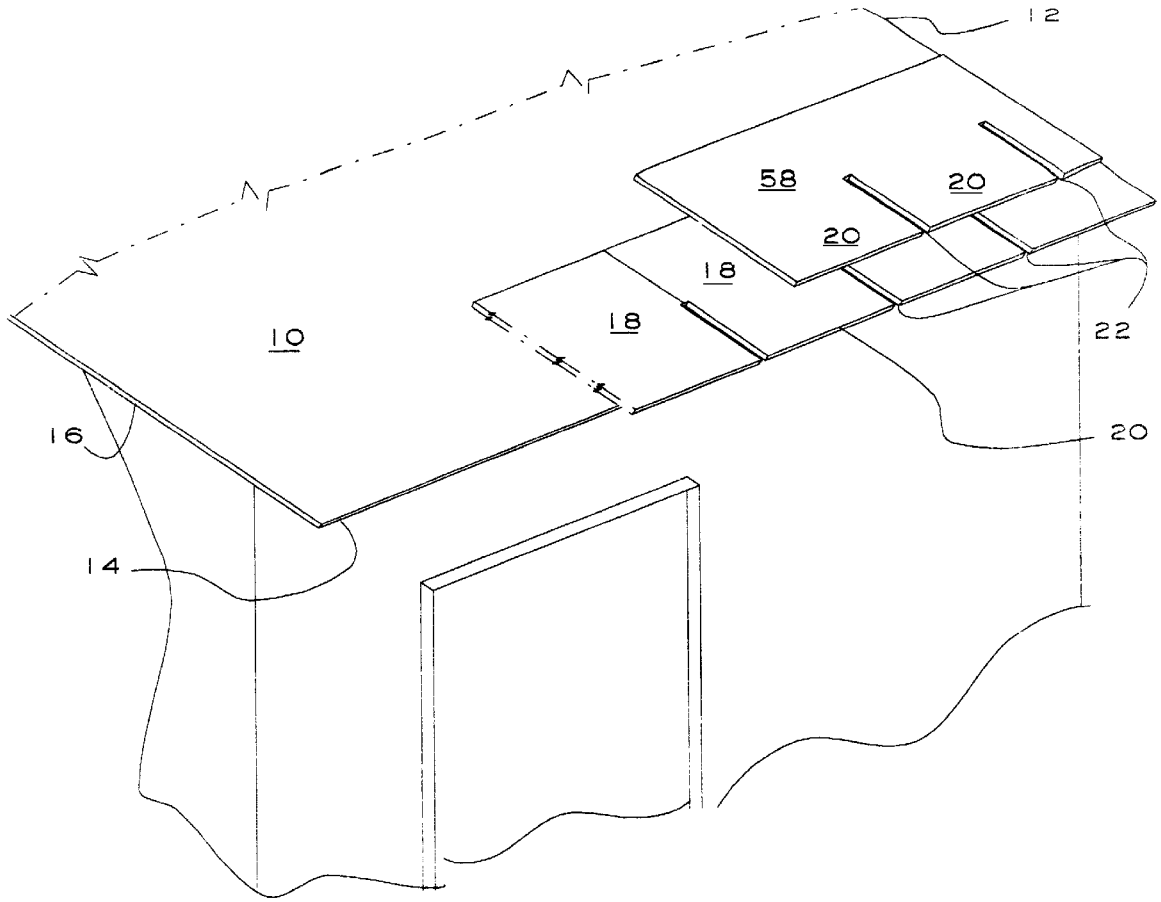
FIG. 1 is a perspective view of a small roof as shingles are being laid.

Turning now to FIG. 1 where a roof 10 having a rake edge 12, an eave edge 14, and a slope 16 is shown. The roof 10 is to be covered with shingles 18, and preferably by composite type shingles of the type having three tabs 20, and having a length "1" and a width "w". These composite shingles are typically thirty six inches in length, by twelve inches in width, and approximately one eighth of an inch thick. The tab cutouts 22 are one quarter of an inch wide and are spaced apart from one another at a distance of eleven and three-quarter inches. Therefore, the shingles 18 are generally rectangular in shape, and have generally parallel sides and ends. One of the sides includes the tabbed sections, and both ends include tab cutouts of one-half of the width of a tab cutout. In other words, each end includes a notch of approximately one eighth of an inch deep and as long as the tab cutouts. It is important to note that while reference is frequently made to the rake edge 12 of the roof 10, principles taught herein are equally applicable to installations commencing from a wall or similar edge feature of the roof.

Figure 2:
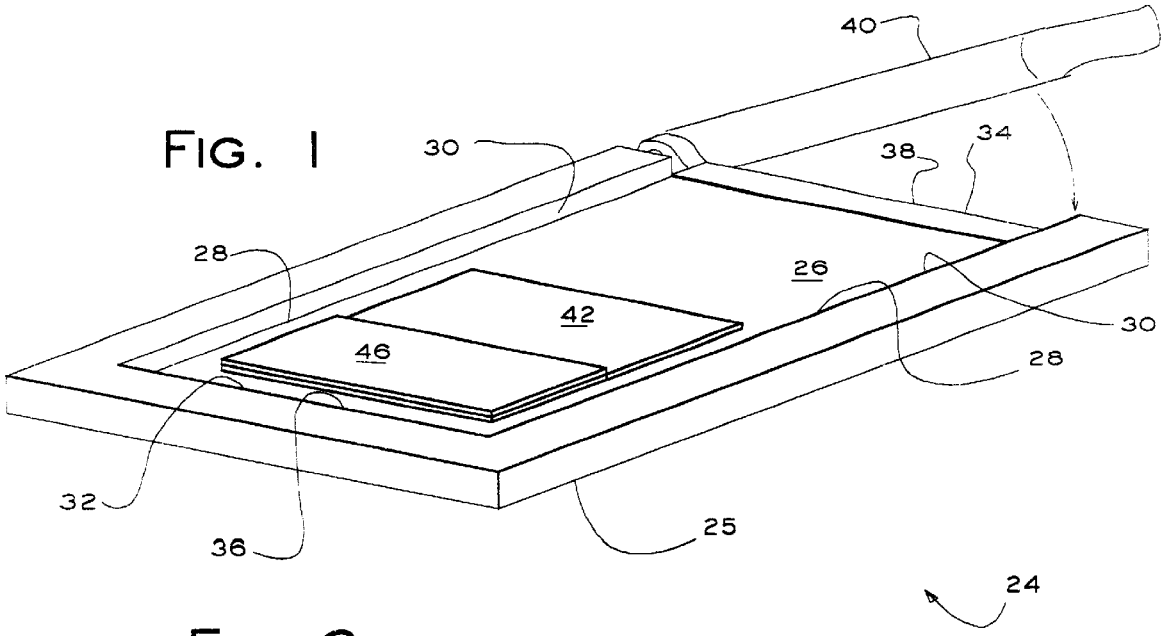
FIG. 2 is a perspective view of a tool made in accordance with the principles taught herein.

Turning now to FIG. 2 where a preferred embodiment of a tool 24 for cutting roofing shingles 18, like the shingles described above has been illustrated. In a preferred embodiment of the tool 24, the tool 24 includes a rectangular base 25 which includes a work surface 26, which in a preferred embodiment will be of a generally rectangular shape. Thus, the work surface includes a pair of sides 28, each of the sides 28 includes guides 30 which extend over the surface 26 to provide a generally straight edge above the work surface 26. It is important to note that while the guides 30 have been illustrated as generally flat surfaces that extend above the work surface 26, it is also contemplated that the guide function may be provided by a pair of pins or other physical obstruction which defines a generally straight line between along the sides 28, and above the work surface 26. Moreover, it is contemplated that the guides 30 will establish generally parallel limits along the sides 28 of the work surface 26 to allow the user to easily properly orient the shingles 18 as they are placed over the work surface 26.

Turning now to FIGS. 2 through 5, it will be understood that the work surface 26 of a preferred embodiment of the tool 24 will include a pair of generally parallel opposing ends 32 and 34, the end 32 having a guide 36 for establishing a straight edge 38 above the work surface 26. The opposite end 34 will accommodate a cutting means 40, which will serve for cutting the shingles 18 placed on the work surface 26 between the sides 28. It is contemplated that the cutting means will consist of a blade mounted next to the straight edge 38. It is further envisioned that this blade may be pivotally mounted next to the edge 38, or it may be slidably supported next to the edge 38. It is also contemplated that the cutting means may be a powered cutting tool, such as a circular or reciprocating blade attached to a drive motor.

By positioning the cutting means 40 near the end 34 of the base 25 and next to the straight edge 38 one provides a cutting tool which can accept and position shingles 18 of the type described above, and position the shingles such that a cut made with the cutting means 40 along the straight edge 38 will result in cut that is perpendicular to the edges or sides of the shingles 18.

To further enhance the utility of the disclosed tool 24, is contemplated that a first guide pedestal 42, of a thickness that is approximately equal to integer multiples of the thickness of the shingles, will be incorporated into the work surface 26 of the base 25. Furthermore, it is contemplated that the guide pedestal 42 will include a guide edge 44. The guide pedestal 42 will preferably be positioned over the work surface 26 in an orientation that will allow the guide edge 44 to be positioned at an orientation that is substantially parallel to the straight edge 38 on the base 25.

It is desirable that the thickness of the guide pedestal 42 or of the guide edge of the pedestal 44 be approximately equal to integer multiples of the thickness of the shingles 18. The use of integer multiples of the thickeners will allow the user to stack or place several shingles over the work surface 26 and against the guide edge 44 of the guide pedestal 42 in order to allow the user to use the cutting means 40 to cut several shingles at once. The pedestals used with the instant invention may or may not extend across the entire work surface 26.

Figure 3:
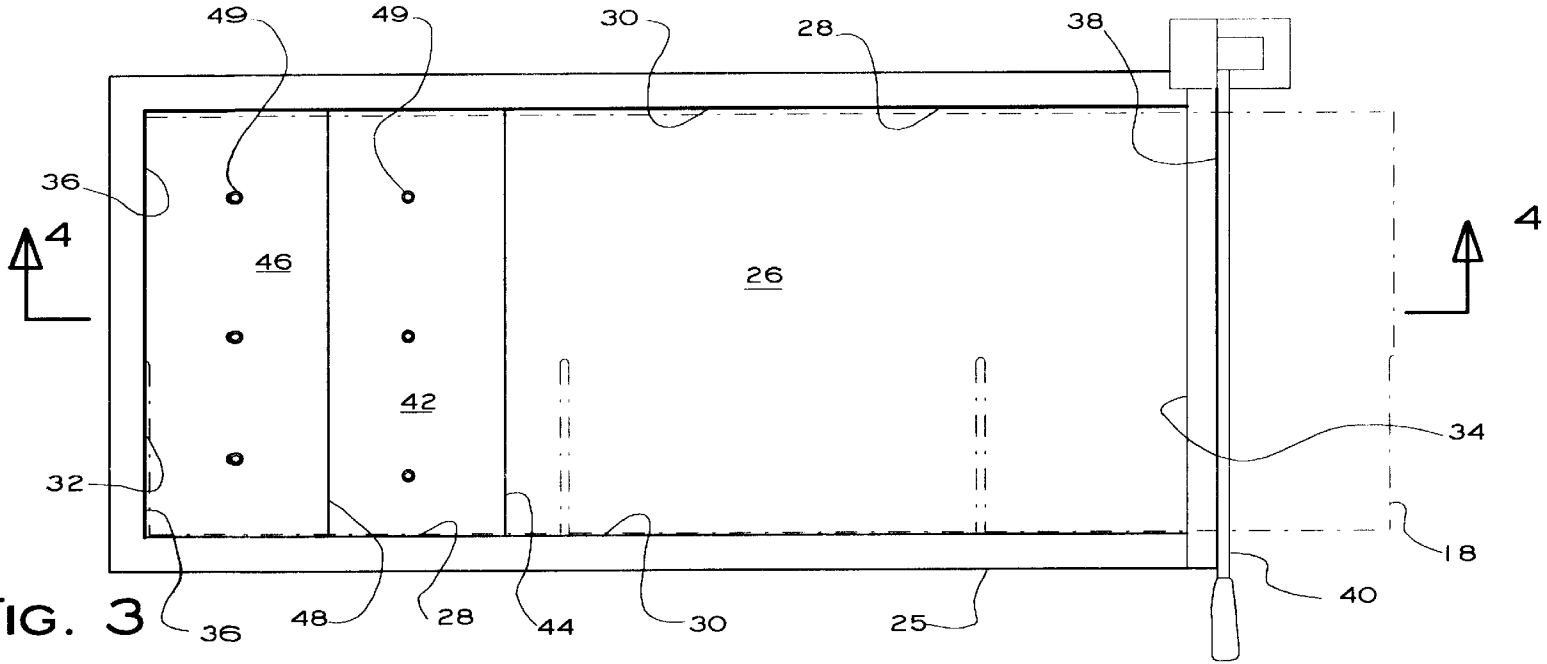
FIG. 3 is a plan view of an embodiment of a shingle cutting tool made in accordance with the principles taught herein.
Figure 4:
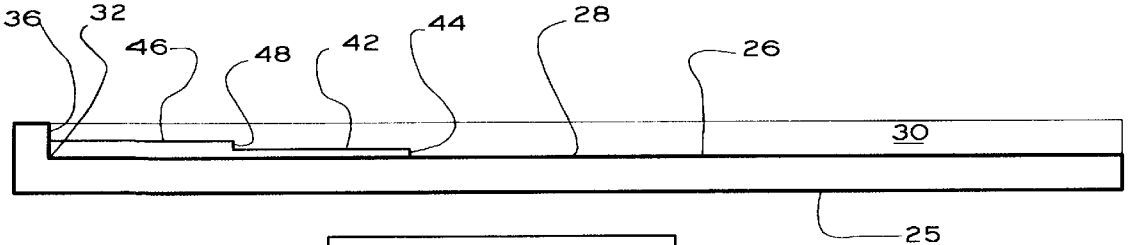
FIG. 4 is a sectional view taken from FIG. 3, at the location indicated in FIG. 3.
Figure 5:
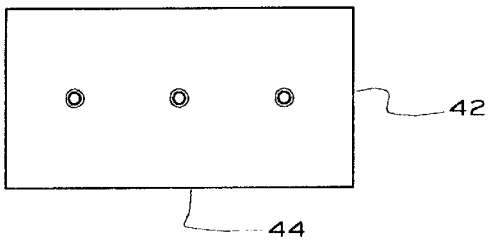
FIG. 5 is a plan view of an embodiment of a stepping insert used with a shingle cutting tool as taught herein.

As shown in FIGS. 2–4, a highly preferred embodiment of the invention will include a second guide pedestal 46 mounted over the work surface 26. A preferred embodiment of the second guide pedestal 46 will also be of a thickness that is approximately equal to integer multiples of the thickness of the shingles and will also include a guide edge 48. Most preferably, the second guide pedestal 46 will be of a thickness that is greater than the thickness of the first guide pedestal 42. Additionally, as shown in the figures, it is contemplated that the second guide pedestal 46 will be closer to the end 32 than the first guide pedestal 42. This arrangement will allow the user to place several shingles 18 over the work surface 26, and between the guides 30, and then slide the shingles against the guide edge 44 of the first guide pedestal 42 so that shingles slid over the first guide pedestal 42 will be slid against the guide edge 48 of the second guide pedestal 46, exposing different sections of the shingles over the work surface 26 to the cutting means 40. This allows the user to produce shingle sections of different sizes when cut with the cutting means 40 across the straight edge 38. It is important to note, that it is contemplated that the invention with its guides 30 may be used to produce accurately cut shingle portions with right angled ends.

According to a highly preferred embodiment of the invention, the guide 36 on the end 32 will stand proud of the work surface 26 by a distance that is greater than the thickness of the second guide pedestal 46 or guide edge 48. This arrangement will allow the user to place several shingles over the work surface 26, and then slide the shingles 18 that are immediately over the work surface 26 against the guide edge 44 of the first guide pedestal 42. The portion of the stack of shingles 18 which is above the guide edge 44 of the first guide pedestal will then be slid against the guide edge 48 of the second guide pedestal 46, and any remaining shingles which are stacked over the guide edge 48 of the second guide pedestal 46 will be slid against the guide 36 on the end 34 of the base 25. Once the shingles have been properly oriented by way of the guides 30 and 36 the guide edges on the pedestals, they will then be cut with the use of the cutting means 40 to produce several shingle fragments, segments or fractions of shingles, the size of the shingle segments being determined by the guide or guide edge against which the shingle was positioned prior to being cut.

Figure 3A:
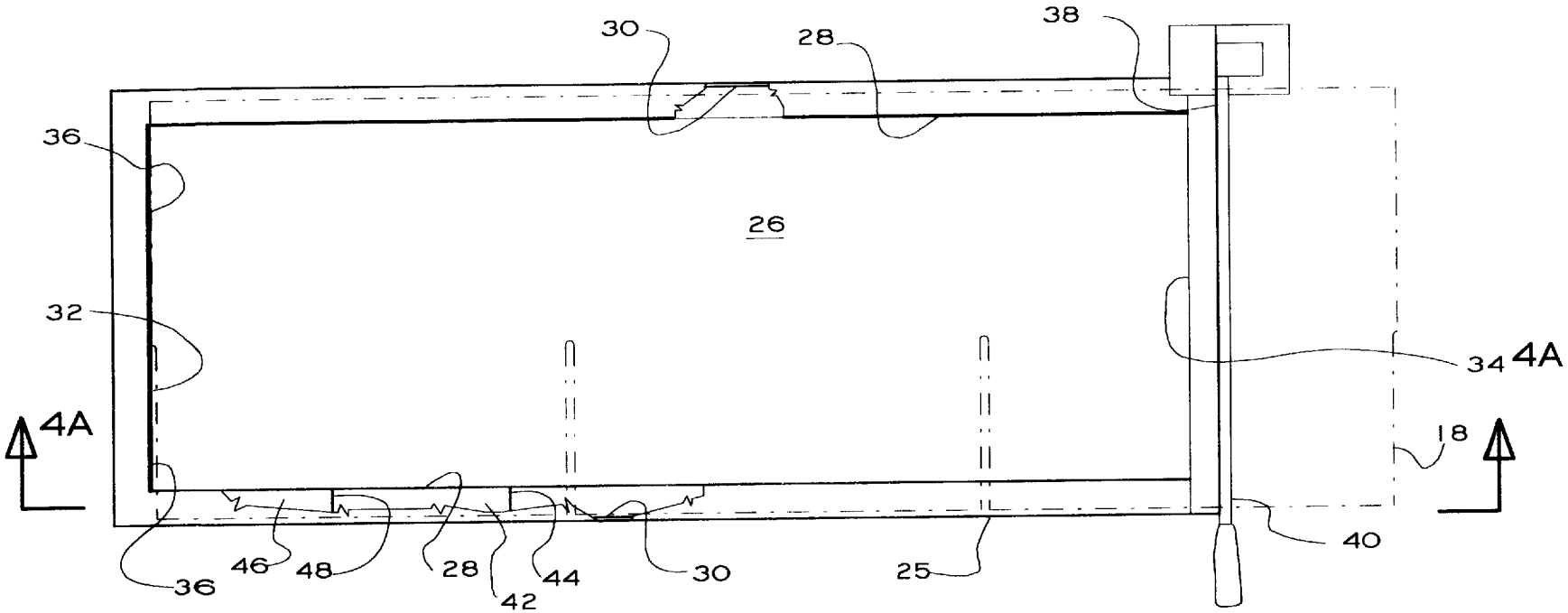
FIG. 3A is a plan view of another embodiment of a shingle cutting tool made in accordance with the principles taught herein. The illustrated shingle cutter incorporating pedestals within a set of C-channel sections mounted at the edge of the work surface.
Figure 4A:
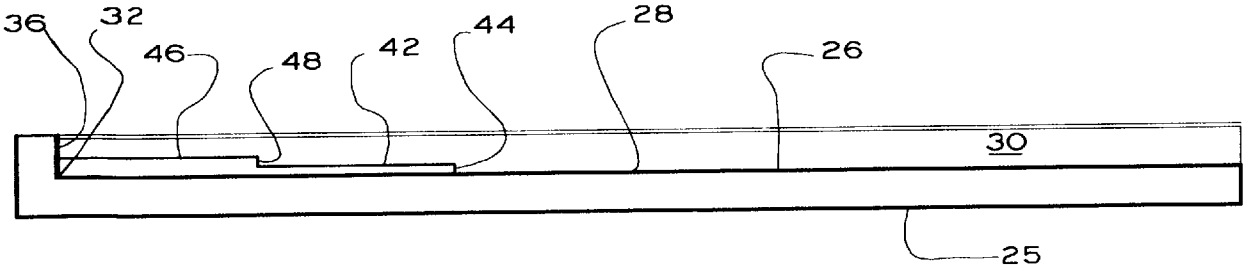
FIG. 4A is a sectional view taken from FIG. 3, at the location indicated in FIG. 3. The view looks into the channel and shows the pedestals residing within the C-channel sections.
Figure 6:
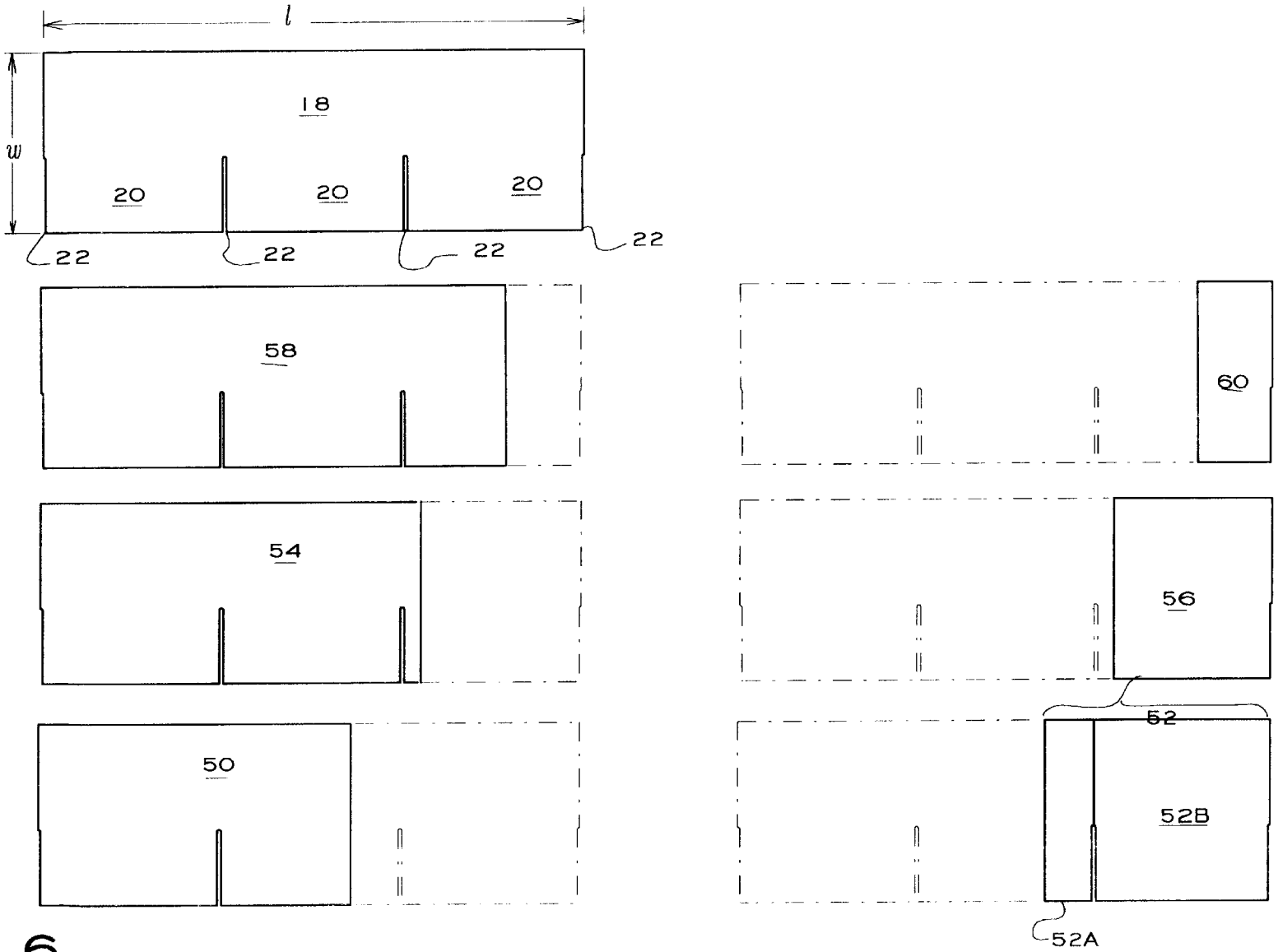
FIG. 6 is a plan view of various sections of shingles formed with a tool made as taught herein.

Still further, it is important to note that it is contemplated that many of the above features may be assembled or achieved with the structure illustrated in FIGS. 3A and 4A. In these figures the pedestals 42 and 46 have been incorporated into a set of C-channel sections which accept the shingles, so that the shingles may be slid back towards the pedestals 42 and 46.

In a highly preferred embodiment of the invention, the guide edge 44 of the first guide pedestal 42 will be at 20 and 4/7 inches from the straight edge 38. This means that when thirty six inch long shingles are placed against the guide edge 44 and cut with the cutting means 40, a pair of cut shingles 50 and 52 will be produced. One cut shingle, shingle 50, will be 20 and 4/7 inches long, while the other cut shingle, shingle 52, will be 15 and 3/7 inches long. According to a preferred embodiment of the invention, cut shingle 52 will be cut once again. This second cut being along the tab cutout 22 to produce a pair of sections, cut shingle 52A and cut shingle 52B. Cut shingle 52A and cut shingle 52B are then positioned on the roof such that the shorter of the cut shingles, cut shingle 52A, is place next to the rake edge 12 of the roof.

Similarly, in a highly preferred embodiment of the invention, guide edge 48 of the second guide pedestal 46 will be placed at 25 and 5/7 inches from the edge 38. Therefore, when shingles 18 are placed against the guide edge 48, cut shingles 54, of 25 and 5/7 inches in length, and cut shingles 56, of 10 and 2/7 inches in length, are produced. It is preferred that the distance from the guide 36 on the end 32 to the straight edge 38 will be 30 and 6/7 inches. Accordingly, shingles 18 stacked against the guide 36 on the end 32 of the base 25, and cut will produce cut shingles 58, of 30 and 6/7 inches in length, and cut shingles 60, of 5 and 1/7 inches in length.

It is important to note that it is contemplated that the guide pedestals 42 and 46 will be removable, and thus allow the user to adjust the thickness or height of the guide edges 44 and 48 achieved with the guide pedestals 46. This removalibity of the guide pedestals 42 and 46 would allow the user to vary the guide pedestals to adjust for variations in thicknesses caused by the use of different shingles, or to replace the guide pedestals 42 and 46 as they become worn. Thus, as shown on FIGS. 3, 4 and 5, it is contemplated that the guide pedestals 42 and 46 will be mounted over the work surface 26 with the use of means for attaching the pedestals, which in the illustrated embodiment include mechanical fasteners 49. Clearly, it is contemplated that various means, mechanical or non-mechanical, for attaching the guide pedestals 42 and 46 may be used to hold the guide pedestals 42 and 46 over the work surface 26. Also, it is important to note that it is contemplated that the guide pedestals 42 and 46 may be formed by stacking layers of sheets of a suitable material to form the guide pedestals 42 and 46 over the work surface 26. For example, it is contemplated that the first guide pedestal 42 may be made from a single sheet of, say, metal of the appropriate thickness to achieve the desired height of the guide edge 44, while the second guide pedestal 46 may be made from a pair of the sheets used to form the first guide pedestal 42.

Figure 7:
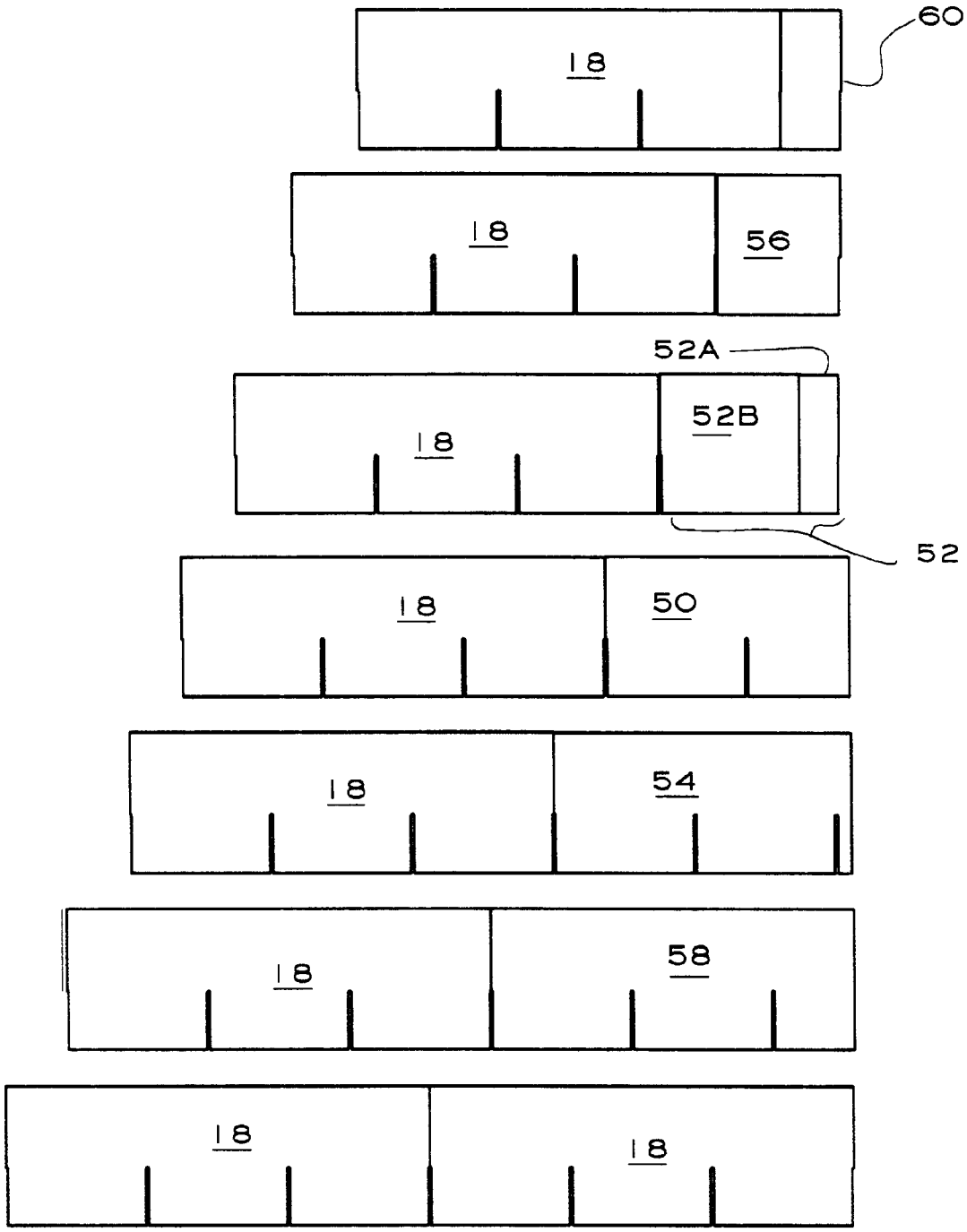
FIG. 7 is a plan view of various sections of shingles formed using the disclosed invention, and illustrating the sequence of sections used to form the roof.
Figure 8:
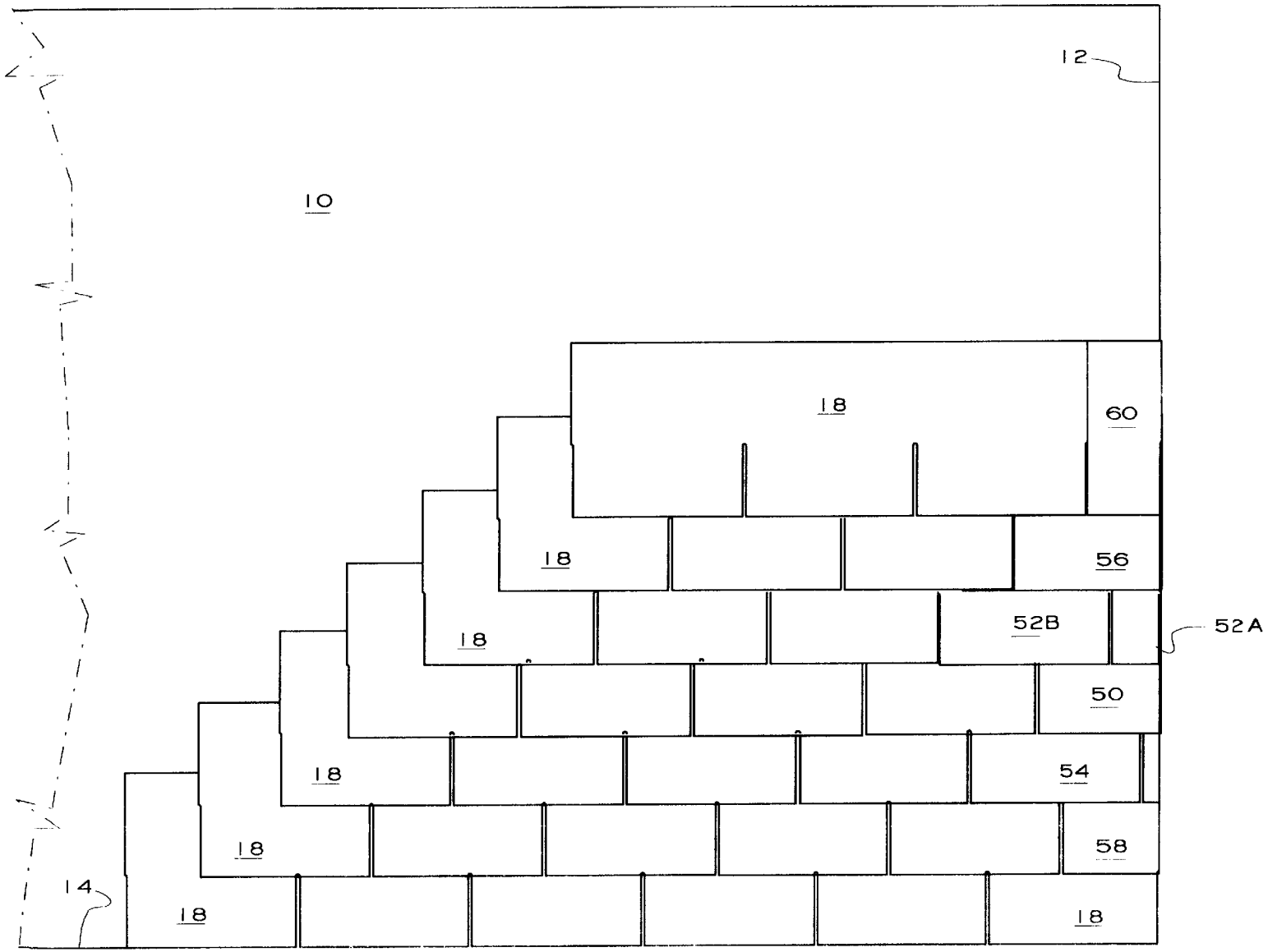
FIG. 8 illustrates the placement of the shingles shown on FIG. 7, as well as additional uncut shingles, to begin the coverage of a roof with the shingles.

Referring to FIGS. 7 and 8 it will be understood that the various cut shingles produced with the disclosed apparatus allow the user to achieve important new and useful results in the installation of the shingles to cover the roof 10. The installation of the roofing material is facilitated in that the user now simply line up the edge of a shingle to be installed with the rake edge 12 of the roof 10 to start a row of shingles. Thus if starting a row at the corner of the roof 10 defined by the intersection of the rake edge 12 and the eave edge 14, the user should first place an uncut shingle 18 against this corner. Then the succeeding row would be started by placing a cut shingle which overlaps the uncut shingle 18 and aligns with the rake edge 12 of the roof 10. In the preferred embodiment of this method, the row started with the uncut shingle 18 is followed with a row that is started with cut shingle 58. Then, the row started with cut shingle 58 is followed with a row started with cut shingle 54. This row is in turn followed by a row started with cut shingle 50, which is followed by a row started with cut shingle 52, then followed by a row started with cut shingle 56, which is followed by a row started with cut shingle 60, and then the same starting sequence is repeated. The sequence of starting shingles has been illustrated in FIG. 7.

Thus it can be appreciated that the disclosed tool and method allows a roof installer to use all of the portions, or sections, of the cut shingles produced with the tool 24. Eliminating waste associated with starting the rows of shingles. Moreover, it will be appreciated that the placement of the starting shingles will be facilitated since the installer or user may now use the rake edge as a guide for the placement of the shingle 18 or cut shingle to be used to start the row. Proper placement of the shingle used to start the row of shingles is important due to the fact that this shingle references the placement of the balance of the shingles in that row. Proper placement of the shingles is particularly important in composite type roofing shingles since the tab cutouts 22 provide reference markings that an observer may use to detect imperfections in the placement of the shingles. Additionally, the tab cutouts 22 often accentuate or draw attention to imperfections which may exist in the placement of the shingles.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A tool for cutting roofing shingles, the tool comprising:

a base having a work surface and ends, said work surface further comprising a pair of sides, each of the sides having guides for establishing a straight edge above the work surface, and one of the ends having a guide for establishing a straight edge above the work surface;

cutting means for cutting shingles placed on the work surface; and a first limiting pedestal, the first limiting pedestal having a guide edge at a distance from the work surface, the guide edge being between one of the ends, so that several shingles stacked over one another and placed over the work surface and slid against the edges of the limiting pedestal to expose different proportions of the shingles to the cutting means, thereby producing shingle sections of different sizes when cutting shingles placed over the work surface.

2. A tool according to claim 1 wherein said work surface further comprises a pair of sides, each of the sides having guides for establishing a straight edge above the work surface; and one of the ends having a guide for establishing a straight edge above the work surface.

3. A tool according to claim 1 and further comprising a second limiting pedestal mounted between the ends and over said work surface.

4. A tool according to claim 3 and further comprising means for removably attaching each of said limiting pedestals against the work surface.

5. A tool according to claim 1 wherein said cutting means comprises a blade movably attached next to the work surface.

6. A tool according to claim 1 wherein said cutting means is slidably mounted next to said_work surface, so that shingles over the work surface are cut by sliding said cutting means next to said work surface.

7. A tool according to claim 1 wherein said work surface comprises a pair of opposing generally parallel sides having guides which are raised over the work surface, the guides being generally perpendicular to the edges of said limiting pedestals.

8. A tool for cutting roofing shingles, the tool comprising:

a rectangular base having:

a work surface having:

a pair of sides, each of the sides having guides for establishing a straight edge above the work surface;

a pair of generally parallel opposing ends, one of the ends having a guide for establishing a straight edge above the work surface; cutting means for cutting shingles placed on the work surface, the cutting means being near the end of the base opposite to the end having a guide; and a first guide pedestal, the first guide pedestal adapted to be of a thickness that is approximately equal to integer multiples of the thickness of the shingles and having a guide edge, so that several shingles stacked over one another and placed over the work surface and so that some of the shingles are slid against the guide edge of the first guide pedestal and so that other shingles slide over the guide pedestal to expose different proportions of the shingles to the cutting means, thereby producing shingle sections of different sizes when cut with the cutting means.

9. A tool according to claim 8 and further comprising a second guide pedestal, the second guide pedestal adapted to be of a thickness that is approximately equal to integer multiples of the thickness of the shingles and having a guide edge, so that shingles slid over the first guide pedestal are slid against the guide edge of the second guide pedestal.

10. A tool according to claim 9 wherein the guide for establishing a straight edge located on one of the ends of the base extends to a distance above the work surface that is higher than the thickness of said second guide pedestal.

11. A tool according to claim 10 wherein said work surface further comprises means for removably attaching said first guide pedestal and said second guide pedestal, so that said first guide pedestal and said second guide pedestal may be removed from said work surface.

12. A tool according to claim 11 wherein said cutting means are slidable mounted next to said work surface.

13. tool according to claim 11 wherein said cutting means comprises a cutting blade that is pivotally attached to said base.

14. A method for installing a shingled roof over a roof having a rake edge, a slope and an eave edge, the method comprising:

providing a first shingle of a size and thickness; providing a second shingle of substantially the same size and thickness as the first shingle;

providing a tool for cutting shingles, the tool comprising:

a base having a work surface, the work surface having sides and ends, the sides having generally parallel guides that protrude over the work surface, and one of the ends having a guide extending over the work surface;

cutting means for cutting shingles placed on the work surface;

a first limiting pedestal and a second limiting pedestal, each of the limiting pedestals having an edge at a distance from the work surface and a support means, the support means of each limiting pedestal being at a distance that is approximately equal to integer multiples of the thickness of the shingles;

placing the first shingle over the work surface and against the edge of one of the first limiting pedestal; placing the second shingle over the first shingle and against the edge of the second limiting pedestal; cutting the shingles over the work surface with the cutting means to produce several cut shingles; and attaching the cut shingles against the rake edge of the roof to be covered.

15. A method according to claim 14 and further comprising providing a third shingle of substantially the same size as the first shingle; and placing the third shingle over the second shingle and against the guide on the end of the work surface.

16. A method according to claim 15 wherein said step of attaching the cut shingles against the rake edge of the roof comprises selecting the largest of the cut shingles and placing the largest shingle against the rake edge and the eave edge; then selecting the next smaller shingle and placing the next smaller shingle over the largest shingle and against the rake edge.

17. A method according to claim 16 and further comprising attaching uncut shingles on the roof next to the cut shingles.

* * * * *